United States Patent [19]

Covi et al.

[11] 4,353,765

[45] Oct. 12, 1982

[54] PROCESS FOR MAKING SINGLE ORNAMENT STONES COATED WITH HEAT-ACTIVATED ADHESIVE

[75] Inventors: Christian Covi, Innsbruck; Martin Pöll, Fritzens, both of Austria

[73] Assignee: D. Swarovski & Co., Osterreich, Fed. Rep. of Germany

[21] Appl. No.: 245,174

[22] Filed: Mar. 18, 1981

Related U.S. Application Data

[63] Continuation of Ser. No. 102,623, Dec. 11, 1979, abandoned.

[30] Foreign Application Priority Data

Dec. 21, 1978 [DE] Fed. Rep. of Germany ..... 2855426

[51] Int. Cl.[3] ..... B29C 17/04

[52] U.S. Cl. ..... 156/212; 63/28; 63/29 R; 63/32; 63/DIG. 1; 156/253; 156/267; 156/285; 156/297; 156/298; 156/309.6; 264/511; 427/208.2; 427/221; 428/15; 428/43; 428/67; 428/349

[58] Field of Search ..... 156/267, 285, 212, 297, 156/250, 298, 253, 309.6, 272; 428/15, 67, 43, 349; 427/221, 208.2; 264/510, 511; 63/28, 29 R, 32, DIG. 1

[56] References Cited

U.S. PATENT DOCUMENTS

| | | | |
|---|---|---|---|
| Re. 20,193 | 12/1936 | Swarovski | 264/511 |
| 4,052,863 | 10/1977 | Pöll | 156/298 |
| 4,138,303 | 2/1979 | Taylor | 156/285 |
| 4,239,824 | 12/1980 | Kasten | 156/298 |
| 4,249,974 | 2/1981 | Wilson | 156/309.6 |

FOREIGN PATENT DOCUMENTS

| | | | |
|---|---|---|---|
| 862784 | 3/1961 | United Kingdom | 63/32 |

*Primary Examiner*—John J. Gallagher
*Attorney, Agent, or Firm*—Bacon & Thomas

[57] ABSTRACT

An account is given of a process for making separate ornament stones with a heat-activated or thermoplastic adhesive coating, in the case of which a number of ornament stones are adhesively joined to a heat-activated adhesive foil and the single stones, with the heat-activated adhesive foil sticking to them, are freed from the compound structure made up of the separate stones and the foil.

With this process single ornament stones may readily and simply be coated with a heat-activated adhesive of a true desired thickness where it is needed on the stones.

2 Claims, 3 Drawing Figures

PROCESS FOR MAKING SINGLE ORNAMENT STONES COATED WITH HEAT-ACTIVATED ADHESIVE

This application is a continuation of application Ser. No. 102,623, filed Dec. 11, 1979, now abandoned.

The present invention relates to a process for making single ornament stones, such as the stones of artificial jewelry, coated with heat-activated adhesive.

In British Pat. No. 862,784 and its German equivalent German Auslegeschrift specification No. 1,079,872 an account is given of ornament stones coated with adhesive which is activated by heat or by solvent. Adhesive may, more specially, be coated on by dipping, spraying on or brushing. As a further possible coating process it is said in this specification that the adhesive may be coated on in the form of a thimble-like unbroken coating-structure covering, more specially, the lower part of each stone. For this purpose the coating is produced from a foil, more specially a plastics foil, which is pressed into the necessary form and then stamped out. The thimble-structures may furthermore be made by casting and then drying.

The processing of great numbers of ornament stones, more specially those of small size, using these earlier suggestions, is very heavy on labor and high in price. For each stone a small thimble of foil first has to be formed separately and then be joined with the stone. It will be clear that this operation, more specially in the case of very small stones of 1 to 3 mm in diameter, has little chance, under normal trade conditions, of outdoing other coating processes as named, that is to say dipping, spraying or brushing on.

However, these other coating processes are, more specially when used for coating a great number of small stones, generally complex and uneconomic. More specially, in these processes, it is hard for the coating to be placed in quite the true position, that is to say only on certain parts of the ornament stone while keeping others uncovered. A further shortcoming in such prior art coating operations is that the adhesive coating may not be kept equally thick all over. The outcome is a coating which, because it is unequally thick, is responsible for shortcomings on further processing of the stones.

In a further earlier suggestion (see U.S. Pat. No. 4,052,863) for making stone-ornamented components the purpose was that of joining together a number of single stones in a certain desired design, a support foil being in the form of heat-activated foil and used for producing a joined-together group of ornament stones. Such components ornamented with stones, or groups of such stones, are used, for example, in jewelry or for use on clothing and shoes. However, the German patent does not give any account of making single stones coated with heat-activated adhesive.

One purpose of the present invention is that of designing a process for making single ornament stones coated with heat-activated (that is to say heat-activable) adhesive, putting an end to the shortcomings of earlier processes and in which, more specially, only certain, desired parts of the stones are covered by the heat-activated adhesive and the coating is even to a very high degree. Furthermore the process is to be simple, trouble-free and generally low-price. Furthermore, the process is to make possible fully scaled-up low-price coating of ornament stones with heat-activated adhesive.

The invention is based on the knowledge of discovery that this purpose may be effected by joining a number of ornament stones in the desired parts with heat-activated foil, which, at the same time, undertakes the function of joining together the stones and then, after this, the single stones, with the heat-activated adhesive foil sticking to them, are broken out of or otherwise freed from the compound structure.

The invention is with respect to a process for making single ornament stones, coated with heat-activated adhesive, characterised in that a number of ornament stones with their ornament faces (that is to say the faces to be seen by the later user of a structure with the ornament stones) turned downwards are placed in spaced hollows in a plate with holes running through it, the ornament faces of the stones being completely or partly within the hollows, and then, generally parallel to the plate, heat-activated foil is placed over the ornament stones, the foil is made plastic by heating and then, by joining holes in the plate, which are joined with the hollows in the plate, with vacuum, the foil is formed against the mounting faces and, if desired, possibly against the ornament faces, the formed-on foil is further heated till adhesively joined with the faces covered by it, and is then cooled down to room temperature and the separate stones with the heat-activated adhesive foil are freed from the compound structure made up of single stones and heat-activated adhesive foil.

More specially in the case of small stones, a useful effect is produced by fixing the heat-activated adhesive foil not only to the mounting faces, but furthermore so as to go up to and past the edge or equator of each stone so as to be present on the ornament faces to some degree.

Furthermore, a useful effect may be produced, on placing the heat-activated adhesive foil on the separate stones, if the heating and vacuum effects are kept up till the foil is made less thick at the limits of the parts of the foil on the stones, so that at this position the foil may be readily broken, that is to say that there is a desired line of breaking for freeing the stones later.

With the process of the present invention it is possible for a number of ornament stones to be coated with heat-activated adhesive in a simple way, the process being different to earlier, old processes by being very low in price. Because of the use of foils of very carefully worked out, controlled size, it is possible for the thickness of the heat-activated foil coating to be controlled in quite the desired way. Furthermore, the process of the invention makes possible the positioning of the heat-activated adhesive coating exactly on the desired parts, that is to say truly those parts where it is needed for further processing of the stones and not on those parts where it is not desired. It is, more specially, to be underlined that the process of the present invention may well be used for coating very small stones whose coating with old processes in the art has not been possible so far at all.

With the process of the present invention it is possible for ornament or decorative stones to be produced responsible for new levels of quality not so far produced in the jewelry industry. The very high level of the adhesive properties of the heat-activated adhesive foil and the mechanical mounting of the stone, which is, more specially, produced when the foil is run over the edge or equator of the stones, and the elastic properties of the heat-activated adhesive foil make certain of processing to make ornaments, whose mechanical properties, more specially with respect to strong mounting, resistance to damage and mechanical forces, more specially blows, far outdo properties in this respect produced so far.

The separate stones are, in the process of the invention, firstly placed on a plate with holes running through it and having hollows which are spaced from each other. In each hollow a stone is placed with the ornament face turned downwards.

The process may be used as a batch process or as a continuous one. For batch processing use may be made of a plane plate with holes through it. However, for continuous processing it is possible to use, in place of such a plane plate, a plate having a cylinder-face which is turned about its axis, the plate having holes through it or being designed for letting air through it in some other way.

The hollows in the plate are preferably the same in form as the stones so that the stones stay in the desired positions. It is clear that the diameters of the hollows will be smaller than the diameters of the stones so that at least the mounting faces of the stones will be kept sticking out of the hollows. The depth of the hollows is dependent, among other things, as to what parts of the ornament stones are to be coated with heat-activated adhesive. If only the mounting faces are to be so coated, the hollows will be so designed that generally the full ornament faces take up positions within the hollows. However, more specially in the case of small stones, it will be best for not only the mounting faces, but furthermore at least a part of the ornament faces to be covered by the heat-activated adhesive foil so that there is a very much better join between the stone and the heat-activated adhesive coating or layer, and, for this reason, between the stones and the structures to be ornamented by them, that is to say on which the stones are fixed. It is more specially to be underlined that by positioning the heat-activated adhesive foil past and round the edge or equator so as to go on to the ornament faces, a mechanical locking of the stone in position is made certain of.

In the case of small stones, that is to say generally stones of 1 to 3.5 mm in diameter, a useful effect is produced if the heat-activated adhesive foil is placed covering about $\frac{1}{3}$ of the ornament faces so that in the case of stones with diameters in the range of 1 to 2.5 mm, the heat-activated adhesive foil will be run about 0.1 to 0.2 mm past the edge of the stone. In the case of stones over 2.5 mm in diameter, the values will be 0.2 to 0.6 mm and in the case of greater sizes of stones because the adhesively joined faces, that is to say the mounting faces, are great in relation, it is not necessary for the foil to go past the equator or edge of each stone.

The plate with the holes running through it is more specially made of, or coated with, a material to which the heat-activated adhesive foil does not become adhesively joined, polytetrafluoroethylene more specially having the desired properties in this respect. The face of the plate with holes, has, at least in the lower parts of the hollows, to be made rough to a certain degree so that the vacuum effect coming by way of the holes through the plate to the hollows, may make its way past the stone and get to the adhesive foil or, putting it differently, so that the air between the foil and the plate may be let off by the vacuum effect through the hollows with the stones in them.

By way of holes opening into the hollows with the stones in them, the vacuum is made to take effect, this keeping the stones in their positions. Nextly, the heat-activated adhesive foil is placed over the stones.

The heat-activated adhesive foil may be in the form of any normal heat-activated adhesive or thermoplastic adhesive responsible for a high-quality adhesive joint on the ornament stone. For example use may be made of polyamides, polyvinyl acetate, polyester resins, epoxy resins, isocyanates and aminoplasts. More specially, the heat-activated adhesive foil is based on thermoplastic polyamide resins.

For the thickness of the foil used, the size of the stone is controlling. A very useful effect is produced because in the present process very thin foils may be used, this making certain of a thin, even coating. In the case of a stone diameter of 1 to 2.5 mm the foil used may, more specially, be 50 to 90 microns thick while for greater stone diameters of 2.5 to 5 mm it is best to make use of 80 to 120 micron thick foils. More specially, for stones of greater size, thicker foils of 200 microns or more may be used.

The heat-activated adhesive foil, once placed over the stones, is nextly changed into a thermoplastic condition by heating, making use, more specially, of an infrared lamp, although other heat producers may be used. For the temperature used the nature of the heat-activated adhesive foil is controlling. Such foils are normally changed into the thermoplastic condition between 100° and 200° C., temperatures in a range round about 130° C. being normally used.

Because of the increase in temperature, on the one hand, the foil becomes plastic and, under the effect of the vacuum used, takes on the form of the stones, while, on the other hand, adhesive properties are activated so that it is adhesively joined to the stones.

The heat-activated adhesive foil may furthermore be colored, as needed for producing specially desired effects.

Because of the somewhat longer heating time with the vacuum in operation, it is possible to make certain that at the position in the foil between the stone and the plate with holes through it, there is a smooth decrease in thickness in the foil. This way of operation is useful because in this way, at the edge of the foil where it is resting against the stone, a less strong connection is produced at which the structure may be readily broken, that is to say there will be a break-line. At these positions the foil goes down in thickness to about 10 to 15 microns. Generally speaking, heating then goes on till at some other position the foil is broken because of the decrease in the thickness and pressures on the two sides of the foil become equal.

The positioning of the foil on the single ornament stones is very simple and makes a high rate of production possible. The melting and sticking on of the heat-activated adhesive foil takes place in a simple, high-speed operation which is completely even and without the foil's being adhesively joined to any other structures. More specially, by the way of effecting the process as noted, by forming a line or position of breaking, a sharp limit is made between the coated faces of the ornament stones and the uncoated faces. Because of the putting on of the made-plastic foil on the ornament stones using vacuum, there is furthermore a completely bubble-free joining of the foil with the desired faces and, for this reason, a good connection between the ornament stones and the foil.

A useful effect may be produced by somewhat stretching the foil while placed over the stones, that is to say pulling it out tight-free of folds, for stopping any building up or running together of heat-activated adhesive anywhere.

Preferably the freeing of the separate stones from the compound structure, that is to say the structure made up of the ornament stones and the heat-activated foil, takes place in a stamping part with holes in it.

A useful effect is, however, produced if, before taking out the separate stones, the regeneration of the heat-activated adhesive be let take place after the temperature has been increased. While it is true that the heat-activated adhesive is quickly cooled to room temperature, it nevertheless keeps in a tough, elastic condition for some time. This is naturally dependent on the sort of heat-activated adhesive used. For this reason, the process is preferably so carried out that the compound structure is stored for a time ranging from some hours to some days and generally about half to one day, at room temperature and only then to take the step of freeing the separate stones from the compound structure.

The stamping part with holes or die, in which the compound structure made up of stones and foil is then placed, has through-holes, one for each stone. The holes of the stamping part are somewhat greater in diameter than the stones, which are more specially placed in with the mounting faces turned downwards, that is to say with the foil-coated part turned downwards, into the stamping part. The holes of the stamping part are acted upon by vacuum, which has the one function of lining up the stones in the stamping part or die and keeping them in this position and on the other hand the purpose of taking off the single stones, once freed, in a downward direction.

The stamping part with holes is placed in a stamping apparatus, in which a stamping male part is moved downwards into the holes of the other stamping part for freeing the stones from the compound structure. The stamping out of the separate stones is generally necessary because the vacuum force is not great enough for freeing the stones by itself.

The process step as noted for freeing the separate stones from the compound structure using a stamping part with holes and with stamping male members has been seen to be of good effect for trade use and is, for this reason, preferred. It will, however, be clear that for freeing the separate stones from the compound structure other ways of operation are possible, as for example: breaking out, washing out, blowing out and the use of a high enough pressure difference, for example of 2 to 10 atm between the two sides of a plate with holes with the compound structure placed on it.

An account will now be given of the invention, making use of one working example which is to be seen in the figures.

The ornament stones 1 are placed so that their ornament faces 6 are in the spaced hollows 3 of a plate 2 with holes running through it.

Figure 1:
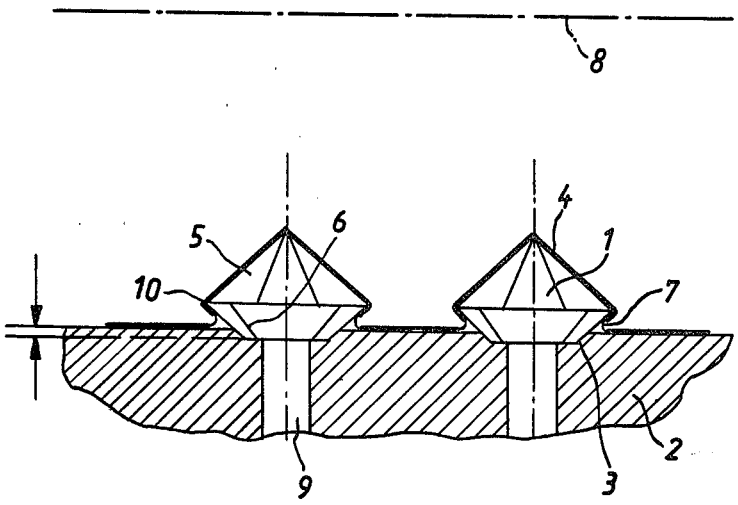
FIG. 1 is a cross-section through a plate with holes, or perforated plate, with the ornament stones and the heat-activated adhesive foil placed on it.

A heat-activated adhesive foil 4 is positioned over the stones and, acted upon by heat from a heat producer or source 8 is changed into a thermoplastic condition. Using a vacuum, taking effect through holes 9, which are joined with the hollows 3, the heat-activated adhesive foil 4 is forced, more specially, against the mounting faces 5. In the working example of the invention of FIG. 1, the heat-activated adhesive foil is moved past and round the outer edges 10 or equators of the ornament stones, so that it comes to rest as well on part of the ornament faces 6, that is to say the faces to be seen by the person using the stones when all processing has been completed. Because of the heating effect, the heat-activated adhesive foil is further activated and is joined adhesively to the ornament stones.

By further heating, while still keeping the vacuum, at the edge of the foil where it is resting against the stones, the foil is decreased in thickness so that a line 7, at which the stones may readily be broken out, is produced, that is to say a line of breaking.

Figure 2:
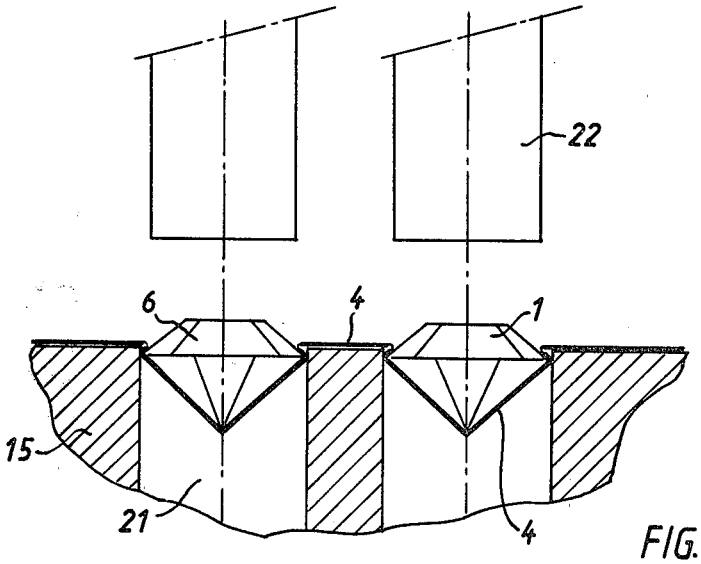
FIG. 2 is a cross-section through a stamping part, in which the stones are freed from the foil-structure using stamping male parts.

After complete joining or sticking of the stones in the desired parts with the support foil, this compound structure is placed in the stamping part 15 with holes, see FIG. 2, that is to say the stones of the compound structure are so placed on the stamping part with holes that their mounting faces, covered with the heat-activated adhesive foil 4, are in the holes 21 of the stamping part 15. These holes 21 are joined up with vacuum so that the stones are put in line.

The stamping part with holes is placed in a stamping apparatus, in which stamping male parts 22 are forced downwards onto the ornament faces 6 of the ornament stones 1 so that the separate stones are freed from the compound structure and, by way of the holes 21, are taken off, this furthermore being effected by the vacuum.

Figure 3:
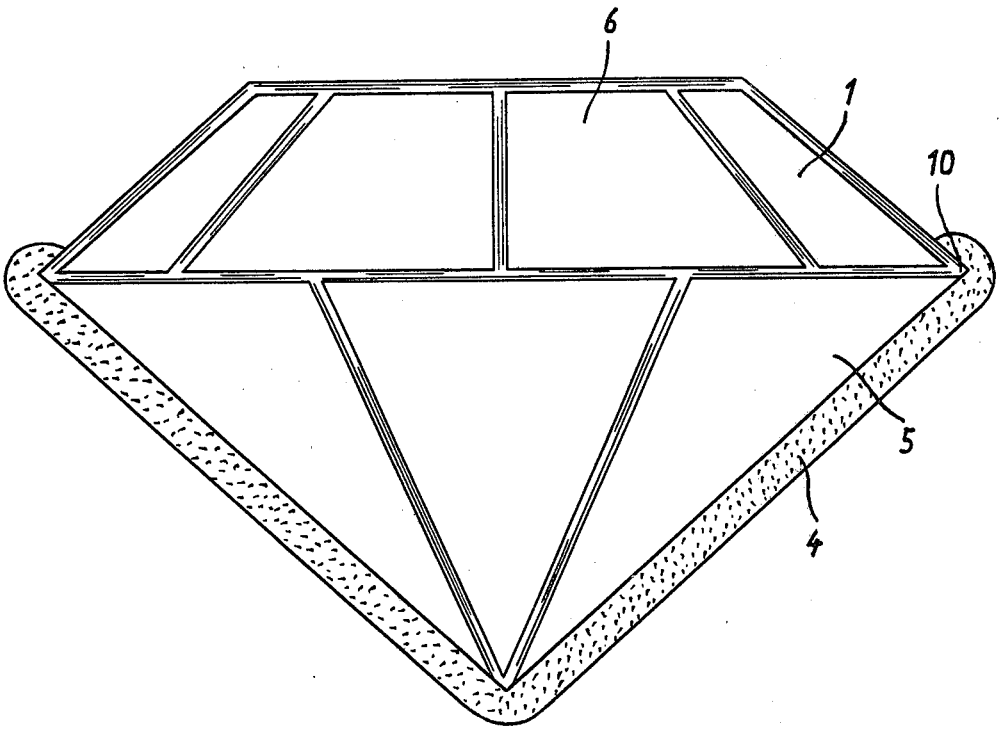
FIG. 3 is a cross-section of an ornament stone with a heat-activated adhesive coating.

It will be seen from FIG. 3 how the heat-activated adhesive foil is pressed partly round the ornament stones so that they are mechanically mounted because heat-activated adhesive foil is forced round the edge or equator of each stone.

The ornament or decorative stones produced with the process of the invention and having the heat-activated adhesive coating may be used for many different purposes in the jewelry and fashion trades because of their even coating with heat-activated adhesive.

We claim:

1. In a process for making single ornament stones with a coating of heat-activated adhesive, including placing a plurality of ornament stones having opposed ornament and mounting faces in spaced apart hollows located on one side of a plate provided with means for applying a vacuum to the bottom area of the hollows with the ornament faces in the hollows, the mounting faces and ornament faces of each stone being divided by a periphery of maximum diameter that is greater than that diameter of the stones that lies in the plane including the apertured side of the plate when the stones are disposed in the hollows, the maximum diameter of each hollow on the side of the plate being smaller than the maximum diameter of the respective ornamental stone in the hollow, placing a sheet of heat-activated and softenable adhesive foil over the mounting faces of the ornament stones with the foil being disposed generally parallel to the plate; drawing the adhesive foil over the mounting faces of the stones towards the plate by applying a vacuum between the foil and the plate through the hollows while heating the foil to soften same to cause the foil to adhere to the stones, the improvement comprising:

drawing the foil over and around the periphery of maximum diameter of the stones by vacuum until the foil extends over and adheres to the mounting face and a portion of the ornamental face of each stone, the applied vacuum and heat being sufficient to cause stretching and thinning of the foil in the areas between the stones and the plate;

cooling the stones and foil to room temperature; and separating individual stones with adhered foil from the unitary assembly of multiple stones and sheet of foil by severing the foil at the thinned areas.

2. The process according to claim 1, wherein the step of separating the stones and adhered foil from the unitary assembly includes placing the stones and adhered foil assembly over a die plate having spaced apertures therein that are slightly larger than the maximum diameter of the respective stones with a stone disposed in registry with each aperture; applying a vacuum to the stones and foil through the apertures; and punching the individual stones with their respective adhered foil layers through the apertures by means of die punches aligned with the apertures, whereby the foil sheet separates along the thinned areas.

* * * * *